US011325408B2

(12) United States Patent
Jaquet et al.

(10) Patent No.: US 11,325,408 B2
(45) Date of Patent: May 10, 2022

(54) DEVICE FOR DRIVING A STAMPING FOIL, STAMPING STATION AND MACHINE, AND METHOD FOR CONTROLLING THE DRIVING OF A STAMPING FOIL

(71) Applicant: BOBST MEX SA, Mex (CH)

(72) Inventors: Bernard Jaquet, Rue (CH); Christophe De Gaillande, Les Monts-de-Corsier (CH); Haoming Song, Shanghai (CN)

(73) Assignee: BOBST MEX SA, Mex (CH)

( * ) Notice: Subject to any disclaimer, the term of this patent is extended or adjusted under 35 U.S.C. 154(b) by 11 days.

(21) Appl. No.: 17/045,729

(22) PCT Filed: Apr. 20, 2018

(86) PCT No.: PCT/CN2018/083835
§ 371 (c)(1),
(2) Date: Oct. 6, 2020

(87) PCT Pub. No.: WO2019/200596
PCT Pub. Date: Oct. 24, 2019

(65) Prior Publication Data

US 2021/0162787 A1 Jun. 3, 2021

(51) Int. Cl.
*B41F 19/06* (2006.01)
*B41F 33/14* (2006.01)
(Continued)

(52) U.S. Cl.
CPC ..... *B41K 3/64* (2013.01); *B41F 16/006* (2013.01); *B41F 19/068* (2013.01); *B41F 33/14* (2013.01); *B41K 3/32* (2013.01); *B41M 1/24* (2013.01)

(58) Field of Classification Search
None
See application file for complete search history.

(56) References Cited

U.S. PATENT DOCUMENTS 3,770,175 A 11/1973 Lale
5,134,931 A * 8/1992 Thompson ..... B41F 3/18 101/27
(Continued)

FOREIGN PATENT DOCUMENTS

CN 1137478 A 12/1996
CN 101407127 A 4/2009
(Continued)

OTHER PUBLICATIONS

International Search Report issued on Jan. 17, 2019, in counterpart International Patent Application No. PCT/CN2018/083835 (3 pages, in English).

*Primary Examiner* — Leslie J Evanisko
(74) *Attorney, Agent, or Firm* — Bookoff McAndrews, PLLC

(57) ABSTRACT

A device for driving a stamping foil over a path through a stamping machine is disclosed herein. The driving device comprises two foil-introduction chain-like elements and a drive member coupled to the foil-introduction chain-like elements for driving the foil-introduction chain-like elements notably through a platen press of a stamping machine. The driving device further comprises at least one first load-measurement device comprising a first detector configured to measure a parameter indicative of the load applied by the drive member for driving the foil-introduction chain-like elements in a first direction, the at least one first load-measurement device being connected to a stamping-machine control unit configured to stop the driving by the drive member when the parameter indicative of the load applied by the drive member and measured by the first detector crosses a threshold.

19 Claims, 4 Drawing Sheets

(51) Int. Cl.

| | |
|---|---|
| ***B41K 3/64*** | (2006.01) |
| ***B41K 3/32*** | (2006.01) |
| ***B41F 16/00*** | (2006.01) |
| ***B41M 1/24*** | (2006.01) |

(56) References Cited

U.S. PATENT DOCUMENTS

| | | | |
|---|---|---|---|
| 5,704,292 | A | 1/1998 | Rebeaud |
| 5,979,308 | A | 11/1999 | Kagi et al. |
| 6,378,750 | B1 | 4/2002 | Disano et al. |
| 7,424,903 | B2 | 9/2008 | Kagi et al. |
| 8,839,719 | B2 | 9/2014 | Badoux |
| 9,067,404 | B2 | 6/2015 | Girard |
| 2013/0327235 | A1 | 12/2013 | Rebeaud |
| 2016/0325574 | A1 | 11/2016 | Chretien |
| 2018/0009215 | A1 | 1/2018 | Wei |

FOREIGN PATENT DOCUMENTS

| | | | |
|---|---|---|---|
| CN | 103097135 | A | 5/2013 |
| CN | 103097136 | A | 5/2013 |
| CN | 105966058 | A | 9/2016 |
| EP | 0858888 | A2 | 8/1998 |
| EP | 1593503 | A2 | 11/2005 |
| JP | H08-169520 | A | 7/1996 |
| JP | 2007-276472 | A | 10/2007 |
| JP | 2008-199961 | A | 9/2008 |
| JP | 2009-112217 | A | 5/2009 |
| JP | 2010-228454 | A | 10/2010 |
| JP | 2012-111144 | | 6/2012 |
| JP | 2013-544197 | A | 12/2013 |
| JP | 2014-180874 | A | 9/2014 |
| JP | 2017-119581 | A | 7/2017 |
| KR | 10-0145483 | | 7/1998 |

* cited by examiner

DEVICE FOR DRIVING A STAMPING FOIL, STAMPING STATION AND MACHINE, AND METHOD FOR CONTROLLING THE DRIVING OF A STAMPING FOIL

CROSS-REFERENCE TO RELATED APPLICATION(S)

This is a National Stage under 35 U.S.C. § 371 of International Application No. PCT/CN2018/083835, filed on Apr. 20, 2018, the contents of which are incorporated by reference in its entirety.

The present invention relates to a device for driving a stamping foil in a machine capable of printing, by stamping, a succession of flat sheet-form elements, notably for the manufacture of packagings. The present invention also relates to a stamping station and machine comprising the driving device. The present invention also relates to a method for controlling the driving of a stamping foil.

Printing text and/or patterns by stamping, namely by using pressure to apply coloured or metallized film from one or more stamping foils to a sheet-form support is known. In industry, such a transfer operation is usually performed using a platen press, into which the print supports are introduced sheet by sheet, whereas each stamping foil is conveyed continuously or step-by-step.

In a standard platen press, stamping takes place between a fixed platen lying horizontally and a platen mounted with the ability to move in a reciprocating vertical movement. Because this type of press is generally automated, transport means are provided for conveying each sheet in turn between the platens. In practice, it is usually a series of bars which each in turn take hold of a sheet along its frontal edge before pulling it between the two platens of the press when the latter are parted sufficiently.

Just like the sheet feeding, the stamping foil feeding of the press is traditionally automated, in this instance by means of a driving system capable of unwinding and conveying the foils along a clearly determined path which notably passes through the platen press.

A foil driving system of this kind comprises a drive bar for introducing the stamping foil into the machine, the bar itself being driven by two foil-insertion chain-like elements which are closed in a loop. The drive bar pulls and unwinds the foil along the path, passing through the press, the foil then being driven by drive rolls belonging to the machine.

Given that the driving system needs to pull and guide the stamping foil through the platen press and that the space between the parted platens is very small, the drive bar and the chain-like elements that drive it need to be very small in thickness and are therefore relatively fragile. If the driving system becomes jammed, for example because of a foil blockage caused by poor unwinding of the foil or the like, the drive bar or the bar attachment may easily break. The machine then has to be stopped to allow the bar to be replaced and then the operator has to reintroduce the stamping foil, partly by hand, which is a lengthy and expensive process.

It is one of the objects of the present invention to propose a stamping-foil driving device in which the risks of breakage are lower.

To this end, one subject of the present invention is a device for driving a stamping foil over a path through a stamping machine, the driving device comprising two foil-introduction chain-like elements and a drive member coupled to the foil-introduction chain-like elements for driving the foil-introduction chain-like elements notably through a platen press of the stamping machine, characterized in that it further comprises at least one first load-measurement device comprising a first detector configured to measure a parameter indicative of the load applied by the drive member for driving the foil-introduction chain-like elements in a first direction, the at least one first load-measurement device being connected to a stamping-machine control unit configured to stop the driving by the drive member when the parameter indicative of the load applied by the drive member and measured by the first detector crosses a threshold.

Driving may thus be stopped before there is a risk of the drive bar or its attachment breaking.

In order to detect possible malfunctioning in the two directions of driving of the foil-introduction chain-like elements, provision is made for example for the driving device to comprise a second load-measurement device comprising a second detector configured to measure a parameter indicative of the load applied by the drive member for driving the foil-introduction chain-like elements in a second direction, the opposite of the first direction, the second load-measurement device being connected to the control unit configured to stop the driving by the drive member when the parameter indicative of the load applied by the drive member and measured by the second detector crosses a threshold.

The driving device may comprise two pairs of lower intermediate transmission elements able to move vertically and aligned horizontally to guide each foil-introduction chain-like element in a horizontal straight line through the platen press. It is thus possible to retract the foil-introduction chain-like elements after the stamping foil has been introduced.

According to a first embodiment of the driving device, the first load-measurement device comprises:

- a first mobile intermediate transmission element,
- a first elastic member which urges the first intermediate transmission element against a foil-introduction chain-like element situated on one side of the drive member and pulled taut when the foil-introduction chain-like element is driven in the first direction, and
- a first actuator configured to apply a counter-thrust to the first elastic member when the foil-introduction chain-like element is driven,
- the first detector being configured to detect when the counter-thrust applied by the first actuator crosses a load threshold.

Where applicable, the second load-measurement device comprises for example:

- a second mobile intermediate transmission element,
- a second elastic member which urges the second intermediate transmission element against a foil-introduction chain-like element situated on one side of the drive member and pulled taut when the foil-introduction chain-like element is driven in the second direction, and
- a second actuator configured to apply a counter-thrust to the second elastic member when the foil-introduction chain-like element is driven,
- the second detector being configured to detect when the counter-thrust applied by the second actuator crosses a load threshold.

The first and/or the second load-measurement device may further comprise at least one additional intermediate transmission element for guiding the foil-introduction chain-like element through an angle of at least 90°.

The first and/or second intermediate transmission element may be interposed between the additional intermediate transmission element and the drive member on the path followed by the stamping foil.

According to a second embodiment of the driving device, the drive member is mounted with the ability to move in a direction of driving of the foil-introduction chain-like element, the first detector being configured to measure when a movement of the drive member indicative of the load applied by the drive member crosses a threshold.

The first load-measurement device comprises for example a first counter-thrust member, such as an actuator, configured to apply a counter-thrust to the drive member when the foil-introduction chain-like element is driven in the first direction, the first detector being configured to detect when the counter-thrust applied by the first counter-thrust member crosses a load threshold.

Where applicable, the second load-measurement device comprises for example a second counter-thrust member, such as an actuator, configured to apply a counter-thrust to the drive member when the foil-introduction chain-like element is driven in the second direction, the second detector being configured to detect when the counter-thrust applied by the second counter-thrust member crosses a load threshold.

The first and/or second load-measurement device comprises for example a linear guide on which the drive member is slidably mounted.

The drive member comprises for example a driveshaft coupled to the foil-introduction chain-like elements by a respective universal joint, making it possible to ensure independence of operation on each side of the machine (driver-side and opposite side).

Another subject of the invention is a stamping-foil feed and recovery station for a machine for stamping elements in sheet form, characterized in that this station comprises a stamping-foil driving device as described hereinabove.

A further subject of the invention is a machine for stamping elements in sheet form, characterized in that it comprises a plurality of workstations including a stamping-foil feed and recovery station as described hereinabove.

Another subject of the invention is a method for controlling the driving of a stamping foil, characterized in that it is implemented by means of a driving device as described hereinabove.

According to a first embodiment of the method for controlling the driving of a stamping foil:

when the foil-introduction chain-like element is driven in a first direction, a first actuator applies a counter-thrust to a first elastic member compression-loaded by the strand of the foil-introduction chain-like element that is pulled taut by the driving of the drive member, a second actuator being inactive, when the foil-introduction chain-like element is driven in an opposite, second, direction, a second actuator applies a counter-thrust to a second elastic member compression-loaded by the strand of the foil-introduction chain-like element that is pulled taut by the driving of the drive member, the first actuator being inactive.

The activated actuators apply a counter-thrust to the elastic members for example in such a way as to keep the intermediate transmission elements in position.

According to a second embodiment of the method for controlling the driving of a stamping foil, the counter-thrust members apply a counter-thrust on each side of the drive member with respect to the direction of driving.

The counter-thrust members apply a counter-thrust to the drive member for example in such a way as to keep the drive member in position.

BRIEF DESCRIPTION OF THE DRAWINGS

Other advantages and features will become apparent on reading the description of the invention, and also from the appended drawings which depict one nonlimiting exemplary embodiment of the invention and in which.

In these figures, identical elements bear the same reference numbers. The following implementations are examples. Although the description refers to one or more embodiments, this does not necessarily mean that each reference relates to the same embodiment or that the features apply only to just one embodiment. Simple features of different embodiments can also be combined or interchanged to provide other embodiments.

The expression "sheet-form elements" is equally applicable to elements made of corrugated board, flat board, paper or any other material commonly used in the packaging industry. It should be understood that throughout this text, the terms "sheet" or "sheet element" or "sheet-form element" very generally refer to any printing support in the form of sheets, such as, for example, sheets of board, paper, plastic, etc.

Figure 1:
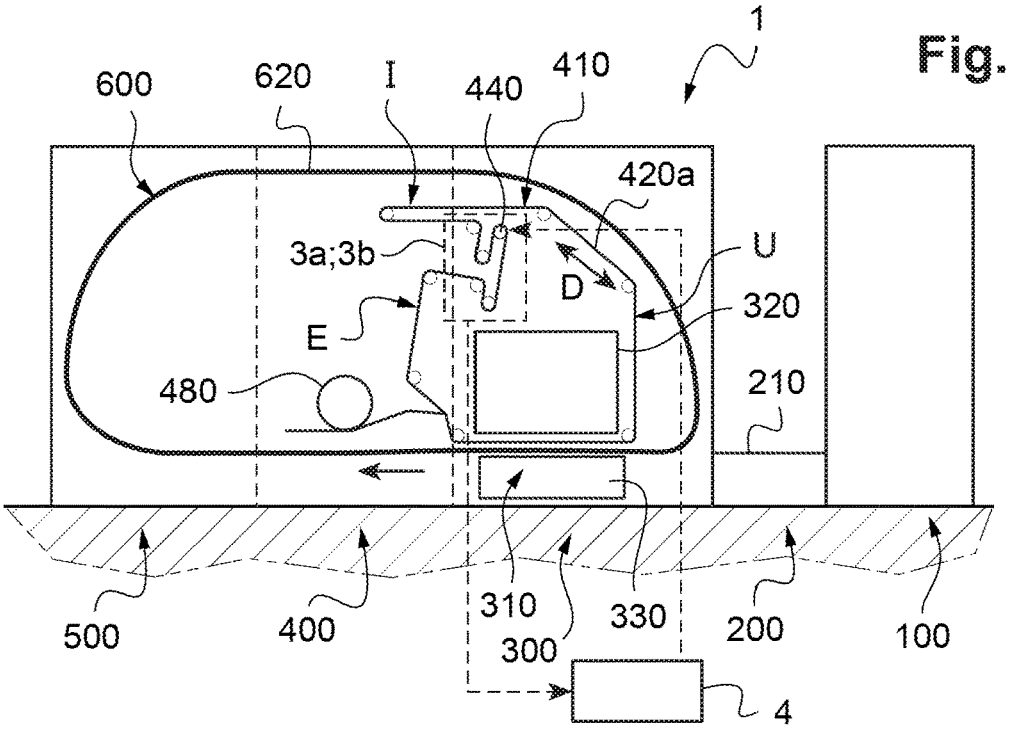
FIG. 1 very schematically illustrates one example of a stamping machine according to a first exemplary embodiment.

FIG. 1 depicts one exemplary embodiment of a sheet-form element stamping machine 1 capable of printing, by stamping, a succession of flat sheet-form elements, notably for the manufacture of packagings.

This machine 1 is conventionally made up of a number of workstations 100, 200, 300, 400, 500 which are juxtaposed but interdependent on one another to form a unit assembly capable of processing a succession of sheet-form elements. Thus, there is a feeder 100, a feeder table 200, a stamping station 300, a stamping-foil feed and recovery station 400, and an delivery station 500. A transport device 600 is also provided for moving each sheet individually from the exit of the feeder table 200 to the delivery station 500, including through the stamping station 300.

In this particular embodiment, which has been chosen solely by way of example, the feeder 100 is stocked by means of a succession of pallets on each of which a plurality of sheets of board are stacked. The latter are removed in succession from the top of the pile by a suction type gripper member which transports them to the immediately-adjacent feeder table 200.

At the feeder table 200, the sheets are laid out in a layer by the suction-type gripper member, which means to say are laid out one after the other in such a way that they partially overlap. The entire layer is then driven along a plate 210 towards the stamping station 300 by means of a belt-type conveying mechanism. At the end of the layer, the lead sheet may be systematically positioned accurately using frontal and lateral lay guides or using a register system.

The workstation situated just after the feeder table 200 is therefore the stamping station 300. The purpose of the latter is to apply to each sheet, by hot stamping, metallized film that comes from a stamping foil. In order to do that, it uses a platen press 310 within which the stamping operation takes place in the conventional way, between a fixed, heated, upper platen 320 and a lower platen 330 which is mounted with the ability to move in a reciprocating vertical movement.

The foil feed and recovery station 400 has the task both of feeding the machine with stamping foil and of removing this same foil once it has become used, downstream of the stamping station 300.

The process of processing the sheets in the printing machine 1 is completed in the delivery station 500, the main purpose of which is to re-stack the previously-processed sheets into a pile. In order to do that, the transport device 600 is for example arranged in such a way as to automatically release each sheet when the latter is in line with this new pile. The sheet then drops squarely onto the top of the pile.

In a very conventional way, the transport device 600 employees a series of gripper bars which are mounted with the ability to move via two chainsets 620 arranged laterally on each side of the stamping machine 1. Each chainset 620 runs in a loop which allows the gripper bars to follow a path that passes in succession through the stamping station 300, the stamping-foil feed and recovery station 400 and the delivery station 500.

Prior to production, the stamping foil is introduced between the platens 320, 330 of the press 310 by a driving device 410 belonging to the foil feed and recovery station 400 and which is capable of conveying it along a determined path.

Figure 2:
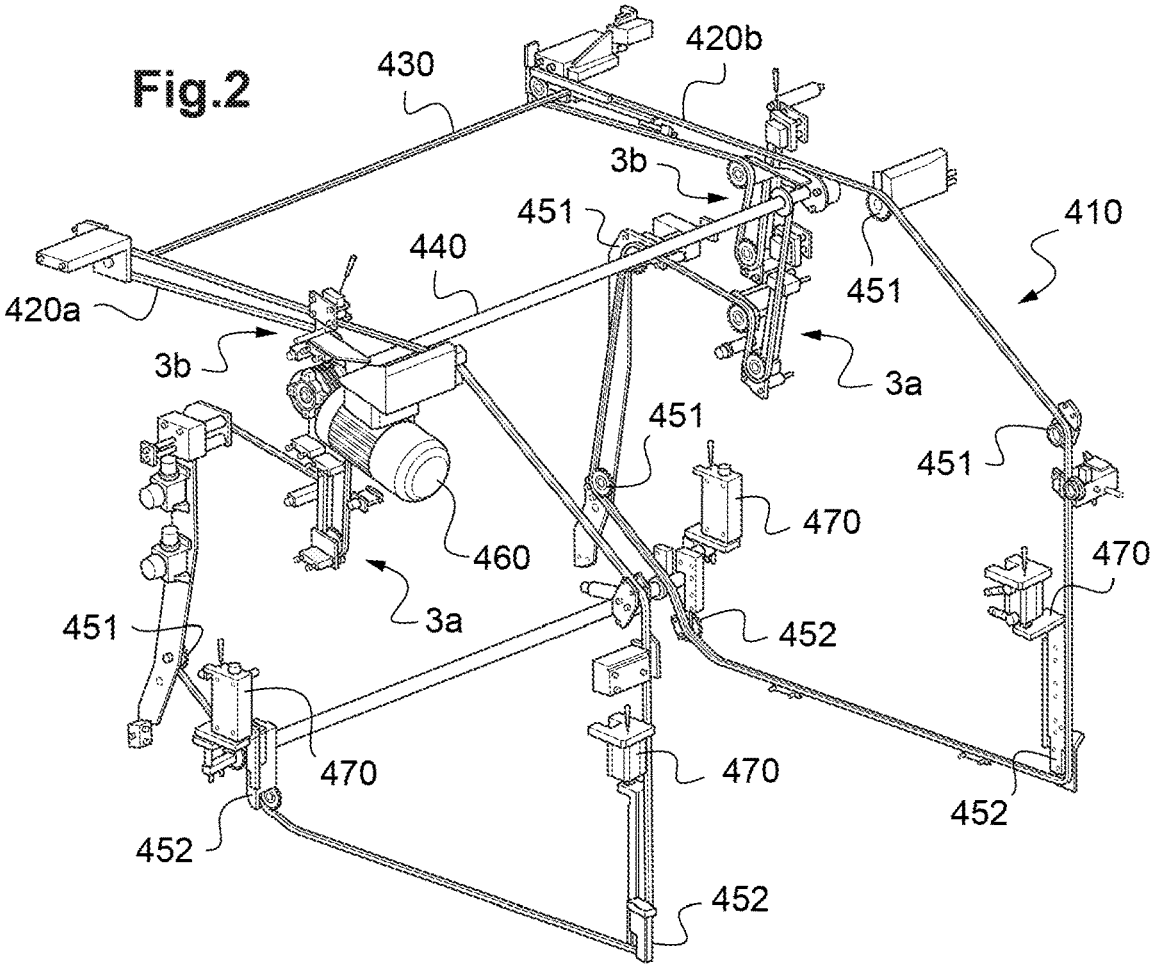
FIG. 2 is a perspective view of a driving device of the stamping-foil feed and recovery station of the machine of FIG. 1, with a drive bar positioned at a point of introduction of the stamping foil.

As is better visible in the example of FIG. 2, the driving device 410 comprises two foil-introduction chain-like elements 420*a*, 420*b* and a drive member 440 coupled to the chain-like elements 420*a*, 420*b* for driving the chain-like elements 420*a*, 420*b*. There are two foil-introduction chain-like elements 420*a*, 420*b* which are arranged laterally in the machine 1, on the one hand on a "driver-side" situated on the side of the operator and, on the other hand, on an "opposite side", situated on the other side of the stamping machine 1.

The foil-introduction chain-like elements 420*a*, 420*b* are, for example, chains (or high-temperature-resistant belts) which are closed on themselves in a loop. The drive member 440 comprises for example a transverse driveshaft coupled to the foil-introduction chain-like elements 420*a*, 420*b* for example via guides or sprocket wheels or pulleys. The drive member 440 is for example set in motion by a motor 460 of the station 400.

A drive bar 430 arranged transversely with respect to the direction of driving D is connected at its ends to the foil-introduction chain-like elements 420*a*, 420*b* to drive the stamping foil for example by winding the foil around the drive bar 430 over 180°.

According to one exemplary embodiment, each foil-introduction chain-like element 420*a*, 420*b* travels in a loop which allows the stamping foil to be unwound over a path passing between an upper point of introduction I (or an intermediate point U), and a lower recovery point E (FIG. 1), making, for example, a circuit of the upper platen 320 of the platen press 310, and passing through the platen press 310.

The drive member 440 may be able to drive the foil-introduction chain-like elements 420 in a first direction and in an opposite second direction: the forward direction and the back direction here defined with reference to the forward direction followed by the stamping foil along its path extending for example from the point of introduction I (or the intermediate point U) towards the recovery point E, passing through the platen press 310.

Thus, in an initial introduction phase, the operator winds the stamping foil around the drive bar 430 by hand. The bar 430 is then made to move in a first direction (or forward direction) over the path passing through the stamping station 300 between the platens of the press 310. The bar 430 then pulls along behind it the two strands of the stamping foil, one strand being pulled taut while the other is unwinding in the machine 1. Then at the exit from the press, the operator removes the free end unwound from the bar 430 to introduce it by hand into a driving roll 480 of the station 400 (FIG. 1). There are, for example, one or several driving rolls 480, each for example advancing the stamping foil by a particular step length.

Once the stamping foil has been unwound, the drive bar 430 can be driven in the opposite direction along the path from the recovery point E towards the point of introduction I (or intermediate point U). The drive bar 430 is, for example, returned to the point of introduction I before the end of introduction of the foil, or the bar can be left at the recovery point E and returned to the point of introduction I when the operator wishes to introduce a new stamping foil with which to feed the machine 1.

After this manual intervention, the drive roll 480 controls the advance of the at least one stamping foil so that the latter coincides with the sheet-form elements introduced elsewhere (not necessarily at the same pace) into the platen press 310 by the gripper bars of the conveying device 600.

Figure 3:
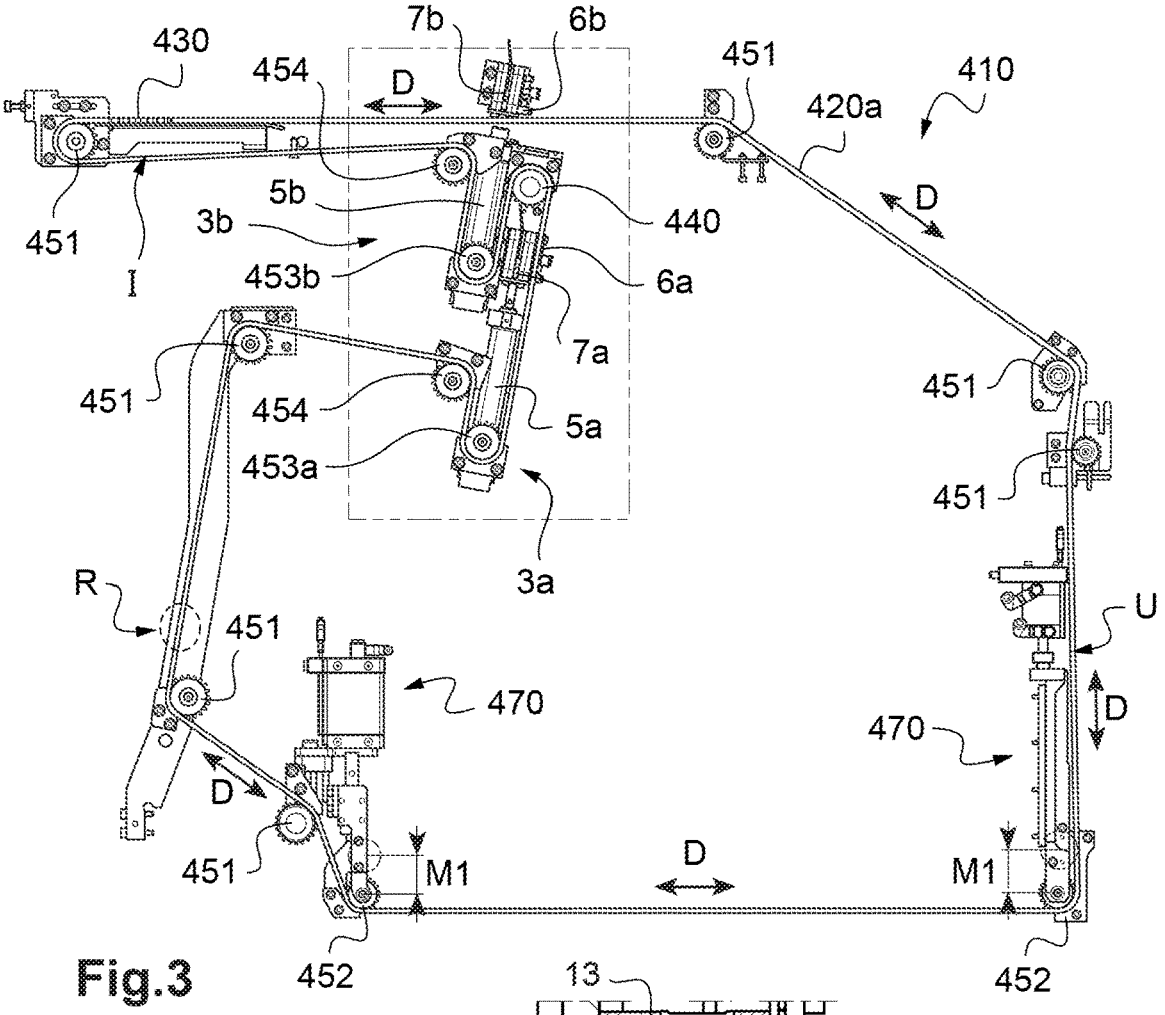
FIG. 3 is a driver-side view of elements of the driving device of FIG. 2.

The driving device 410 further comprises for example a series of intermediate transmission elements 451, 452, such as wheels 451, 452 or skids, which are installed along the path to guide the foil-introduction chain-like elements 420*a*, 420*b* and thus the movement of the stamping foil (FIG. 3). The driving device 410 comprises for example notably two pairs of lower intermediate transmission elements 452, such as wheels, able to move vertically (over the distance M1) and aligned horizontally to guide each foil-introduction chain-like element 420*a*, 420*b* in a horizontal straight line through the platen press 310. Each mobile intermediate transmission element 452 is for example moved by means of its own controllable actuator 470 such as a ram. It is thus possible to make the drive bar 430 pass between the platens 320, 330 of the press 310 in order to introduce the stamping foils, and then retract the foil-introduction chain-like elements 420*a*, 420*b* before production, by raising the intermediate transmission elements 452 for example.

The driving device 410 further comprises at least one first load-measurement device 3*a* comprising a first detector 7*a* configured to measure a parameter indicative of the load applied by the drive member 440 for driving the foil-introduction chain-like elements 420*a*, 420*b* in a first direction. The at least one first load-measurement device 3*a* is connected to a control unit 4 of the stamping machine 1

(FIG. 1) configured to stop the driving by the drive member 440 when the parameter indicative of the load applied by the drive member 440 and measured by the first detector 7*a* crosses a threshold, such as a load greater than 100N or 150N for example.

The control unit 4 is for example a computer of the stamping machine 1.

It is possible to provide just one load-measurement device 3*a* or 3*b* per chain-like element 420*a*, 420*b*. However, given that the drive member 440 may drive the foil-introduction chain-like elements 420*a*, 420*b* in both directions, the driving device 410 may comprise a second load-measurement device 3*b* for measuring load applied in the second (for example back) direction.

The second load-measurement device 3*b* thus comprises a second detector 7*b* configured to measure a parameter indicative of the load applied by the drive member 440 for driving the foil-introduction chain-like elements 420*a*, 420*b* in the second direction, the second load-measurement device 3*b* being connected to the control unit 4 configured to stop the driving by the drive member 440 when the parameter indicative of the load applied by the drive member 440 and measured by the second detector 7*b* crosses a threshold.

Provision is made for example for the driving device 410 to comprise two pairs of load-measurement devices 3*a*, 3*b*, one pair of load-measurement devices 3*a*, 3*b* being arranged on a respective foil-introduction chain-like element 420*a*, 420*b* so as to detect an overload on each of the foil-introduction chain-like elements 420*a*, 420*b*.

In the first exemplary embodiment, the first measurement device 3*a* further comprises a first mobile intermediate transmission element 453*a*, a first elastic member 5*a* and a first actuator 6*a* (FIG. 3).

A first end of the first elastic member 5*a* urges the first intermediate transmission element 453*a* against one strand of a foil-introduction chain-like element 420*a*, 420*b* situated on one side of the drive member 440 and pulled taut when the foil-introduction chain-like element 420*a*, 420*b* is driven in the first direction along the path of the stamping foil.

The first actuator 6*a* is configured to apply a counter-thrust to a second end of the first elastic member 5*a* when the foil-introduction chain-like element 420*a*, 420*b* is driven, for example so as to keep the first mobile intermediate transmission element 453*a* in position.

The first detector 7*a* is configured to detect when the counter-thrust applied by the first actuator 6*a* crosses a load threshold.

Likewise, the second measurement device 3*b* comprises for example a second mobile intermediate transmission element 453*b*, a second elastic member 5*b*, a second actuator 6*b* and a second detector 7*b*.

A first end of the second elastic member 5*b* urges the second intermediate transmission element 453*b* against one strand of the foil-introduction chain-like element 420*a*, 420*b* situated on one side of the drive member 440 and pulled taut when the foil-introduction chain-like element (420*a*, 420*b*) is driven in the second direction. There is therefore one elastic-member/intermediate-transmission-element assembly on each side of the drive member 440.

The second actuator 6*b* is configured to apply a counter-thrust to a second end of the second elastic member 5*b* when the foil-introduction chain-like element 420*a*, 420*b* is driven, for example so as to keep the second mobile intermediate transmission element 453*b* in position.

The second detector 7*b* is configured to detect when the counter-thrust applied by the second actuator 6*b* crosses a load threshold.

The mobile intermediate transmission elements 453*a*, 453*b* are for example guides, pulleys, sprocket wheels or skids.

The actuators 6*a*, 6*b* are for example rams, such as pneumatic rams.

The detectors 7*a*, 7*b* are for example proximity sensors, namely contactless sensors, such as magnetic sensors. They may be incorporated into a respective actuator 6*a*, 6*b*. The detectors 7*a*, 7*b* for example send an electrical signal back to the control unit 4 when the measured parameter indicative of the load applied by the drive member 440 crosses a threshold.

The elastic members 5*a*, 5*b* comprise for example compression springs.

Figure 4:
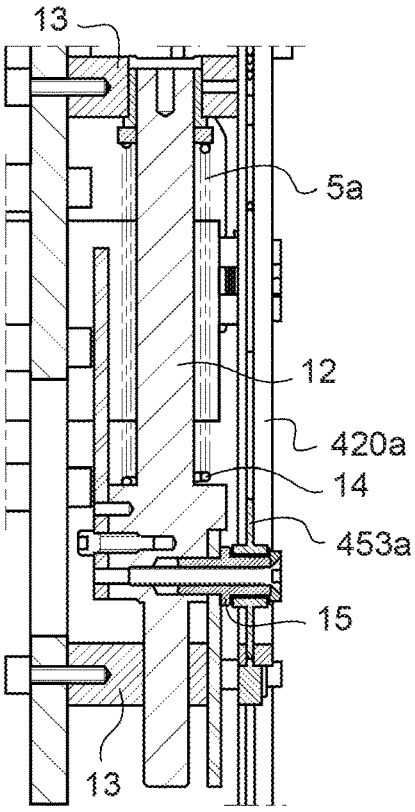
FIG. 4 is a view in cross section of a detail of the driving device of FIG. 3.

According to one exemplary embodiment best visible in FIG. 4, the elastic member 5*a*, 5*b* comprises a compression spring surrounding a guide 12 slidably mounted between two bearings 13. A first end 14 of the spring 5*a* bears against the guide 12, the guide 12 being fixed (in this instance at right angles) to the pivot 15 of the intermediate transmission element 453*a*, 453*b*. The movement of the intermediate transmission element 453*a*, 453*b* is therefore as one with the movement of the guide 12, the guide 12 moving with the load applied to the second end of the spring.

The axes of the elastic members 5*a*, 5*b* are for example perpendicular to the direction of driving D of the foil-introduction chain-like elements 420*a*, 420*b*.

The load-measurement devices 3*a*, 3*b* further comprise, for example, at least one respective additional intermediate transmission element 454, such as a guide, pulley, sprocket wheel or skid, to guide the foil-introduction chain-like element 420*a*, 420*b* over an angle of at least 90°, such as 180° (FIG. 3) . The intermediate transmission element 453*a*, 453*b* is for example formed of a wheel situated in the belly of a loop of the foil-introduction chain-like element 420*a*, 420*b*, for example interposed between the additional intermediate transmission element 454 and the drive member 440 on the path followed by the stamping foil.

One example of the operation of a method for controlling the driving of a stamping foil by means of the driving device 410 will now be described with reference to FIGS. 5*a*, 5*b* and 5*c*.

Figure 5A:
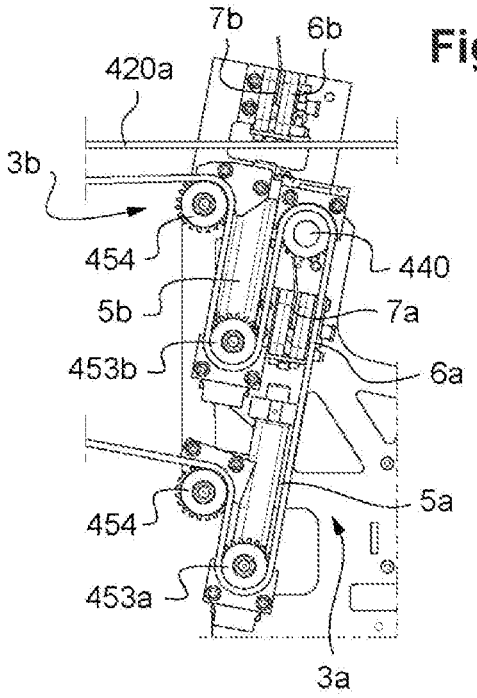
FIG. 5*a* shows a first and a second load-measurement device of the driving device of FIG. 3, in a standby position.

In FIG. 5*a*, the load-measurement devices 3*a*, 3*b* are initially in a standby position. The motor 460 and the actuators 6*a*, 6*b* are stationary, the drive member 440 is immobilized. The operator adjusts the heightwise position of the mobile intermediate transmission elements 452 in order to position the foil-introduction chain-like elements 420*a*, 420*b* at the height of the platen press 310 (FIG. 3). As a result of this, the mobile intermediate transmission elements 453*a*, 453*b* of the load-measurement devices 3*a*, 3*b* move against the action of the elastic members 5*a*, 5*b*. A minimal tension is exerted between the elastic members 5*a*, 5*b* and the foil-introduction chain-like elements 420*a*, 420*b*.

The first actuator 6*a* is activated. It applies a counter-thrust to the first elastic member 5*a* thus compression-loaded by the strand of the foil-introduction chain-like element 420*a*, 420*b* that is pulled taut by the driving of the drive member 440, for example so as to keep the first mobile intermediate transmission element 453*a* in position. The ram rod of the first actuator 6*a* extends for example until it presses against the second end of the first elastic member 5*a*. The first intermediate transmission element 453*a* is kept in position.

Figure 5B:
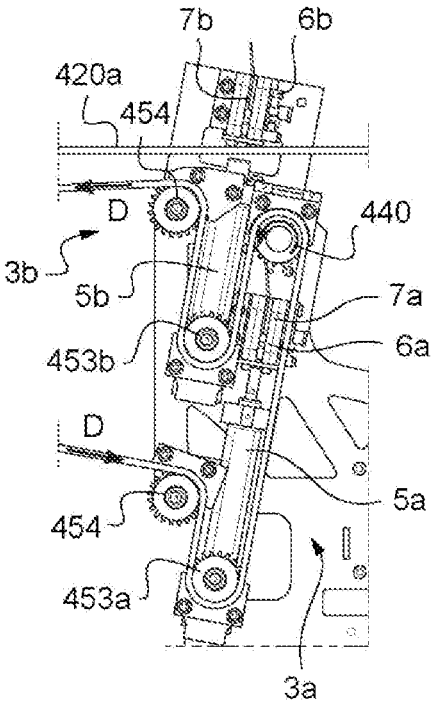
FIG. 5*b* shows the load-measurement devices of FIG. 5*a* when the foil-introduction chain-like element is driven in a first direction, during normal operation.
Figure 5C:
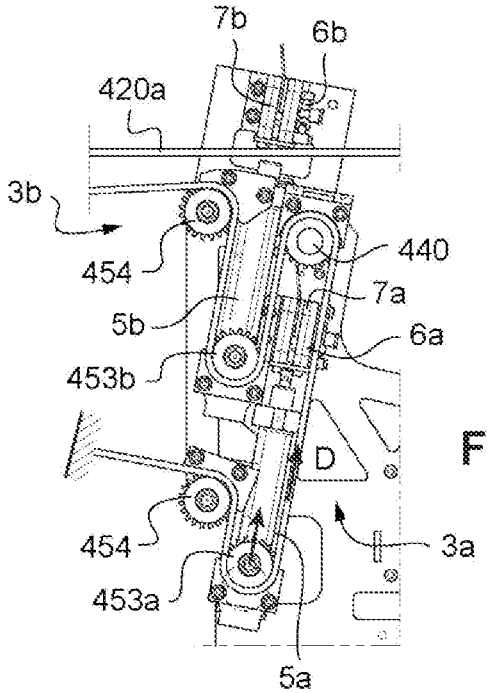
FIG. 5*c* shows the load-measurement devices of FIG. 5*b* when the load applied by a drive member crosses a threshold.

After the motor 460 has started, the drive member 440 may drive the foil-introduction chain-like elements 420*a*, 420*b* in a first direction (or forward direction, arrow D, FIG. 5*b*).

On the other side of the drive member 440, the second actuator 6*b* is inactive. The tension in the strand of the foil-introduction chain-like element 420*a* is determined by the second elastic element 5*b*. The ram rod of the second actuator 6*b* is retracted (FIG. 5*b*).

Should anything happen to block the advance of the foil-introduction chain-like elements 420*a*, 420*b*, the counter-thrust applied by the first actuator 6*a* will no longer be enough to keep the first mobile intermediate transmission element 453*a* in position and it will move (in this instance upwards, FIG. 5*c*) and the travel of the first actuator 6*a* reduces. These elements for example allow the first detector 7*a* to detect that the counter-thrust applied by the first actuator 6*a* is crossing a load threshold. The control unit 4 then stops the driving by the drive member 440 for example by cutting the supply of power to the motor 460.

Driving may thus be stopped before there is a risk of the drive bar 430 or its attachment breaking.

In normal operation, the drive member 440 may also drive the foil-introduction chain-like elements 420*a*, 420*b* in the opposite second direction (or back direction) (for example by turning anticlockwise).

The second actuator 6*b* is then activated. It applies a counter-thrust to the second elastic member 5*b* thus compression-loaded by the strand of the foil-introduction chain-like element 420*a*, 420*b* that is pulled taut by the driving of the drive member 440, for example so as to keep the second mobile intermediate transmission element 453*b* in position. The ram rod of the second actuator 6*b* extends for example until it presses against the second end of the second elastic member 5*b*. The second intermediate transmission element 453*b* is kept in position.

On the other side of the drive member 440, the first actuator 6*a* is inactive. The tension in the strand of the foil-introduction chain-like element 420*a* is determined by the first elastic element 5*a*. The ram rod of the first actuator 6*a* is retracted.

Should anything happen to block the advance of the foil-introduction chain-like elements 420*a*, 420*b*, the counter-thrust applied by the second actuator 6*b* will no longer be enough to keep the second mobile intermediate transmission element 453*b* in position and it will move (in this instance upwards) and the travel of the second actuator 6*b* reduces. These elements for example allow the second detector 7*b* to detect that the counter-thrust applied by the second actuator 6*b* is crossing a load threshold. The control unit 4 then stops the driving by the drive member 440 for example by cutting the supply of power to the motor 460.

Figure 6:
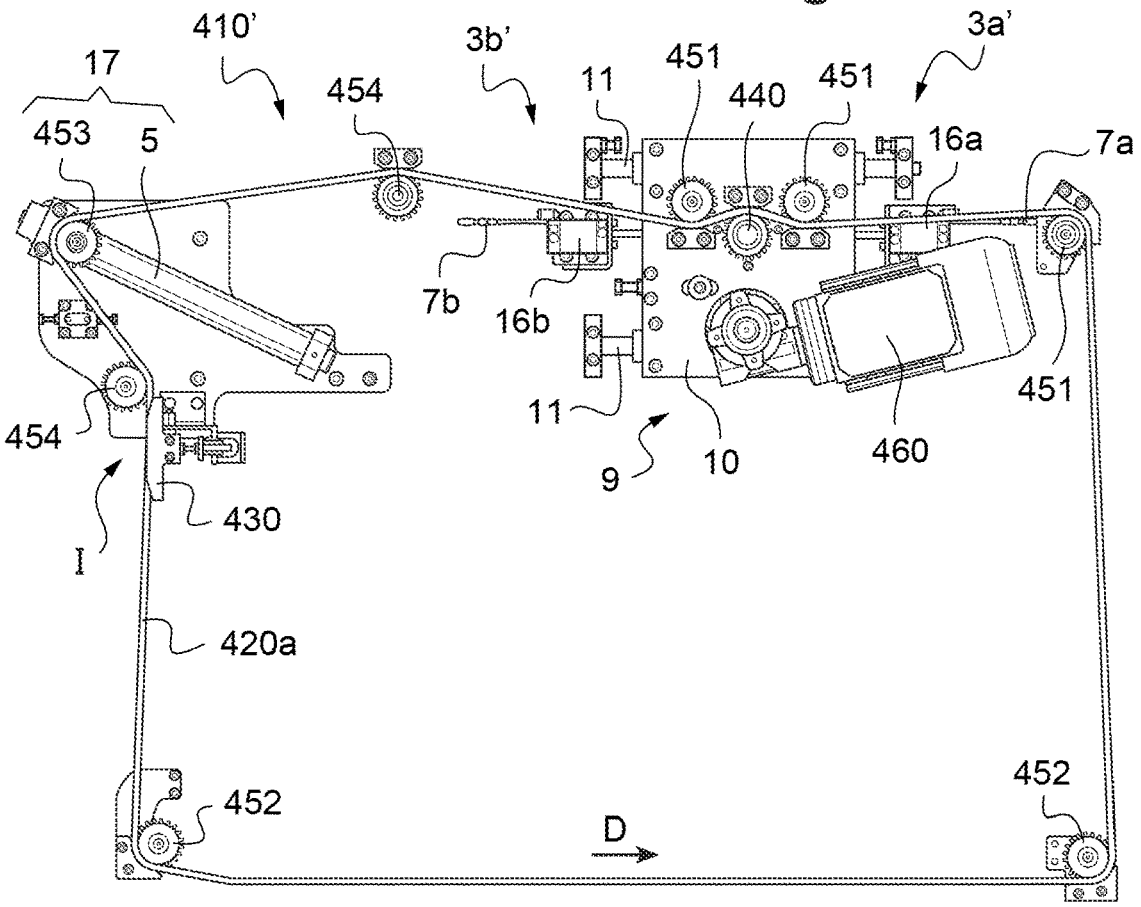
FIG. 6 is a driver-side view of a driving device of the stamping-foil feed and recovery station according to a second exemplary embodiment, with a drive bar positioned at a point of introduction of the stamping foil.
Figure 7:
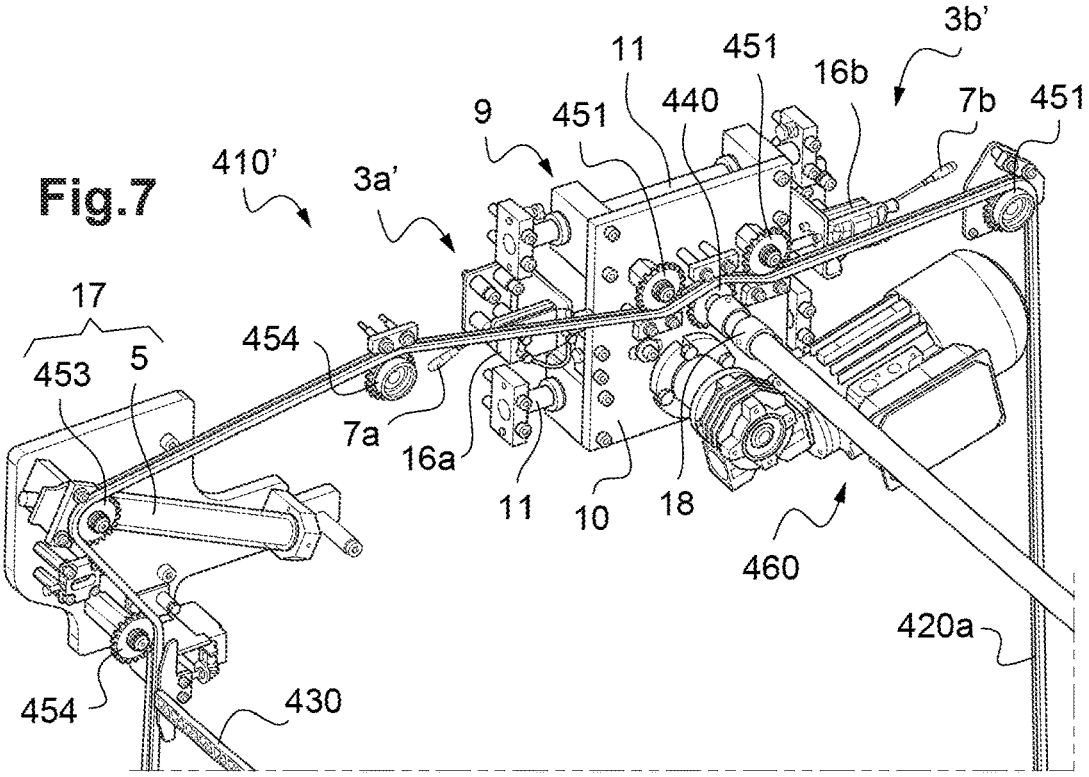
FIG. 7 shows elements of FIG. 6 viewed from the inside of the machine.

FIGS. 6 and 7 illustrate a second exemplary embodiment of the driving device 410'.

As previously, the driving device 410' comprises a first load-measurement device 3*a*' comprising a first detector 7*a* configured to measure a parameter indicative of the load applied by the drive member 440 for driving the foil-introduction chain-like elements 420*a*, 420*b* in a first direction. The first load-measurement device 3*a*' is connected to the control unit 4 of the stamping machine 1 (FIG. 1) configured to stop the driving by the drive member 440 when the parameter indicative of the load applied by the drive member 440 and measured by the first detector 7*a* crosses a threshold.

This second embodiment differs from the previous one in that the load-measurement device does not apply any counter-load against the foil-introduction chain-like elements 420*a*, 420*b*. In this second embodiment, the drive member 440 is mounted with the ability to move in a direction of driving D of the foil-introduction chain-like elements 420*a*, 420*b*.

For that, the first load-measurement device 3*a*' comprises for example a linear guide 9 on which the drive member 440 is slidably mounted. The linear guide 9 for example allows the drive member 440 to move horizontally in an upper zone of the foil-introduction chain-like elements 420*a*, 420*b*. The linear guide 9 for example comprises a mobile support 10, such as a plate, sliding along at least one fixed horizontal spindle 11, such as two spindles 11 arranged one above the other.

Furthermore, in this embodiment, the first detector 7*a* is configured to measure when a movement of the drive member 440 indicative of the load applied by the drive member 440 crosses a threshold.

The drive member 440 comprises for example a transverse driveshaft coupled to the foil-introduction chain-like elements 420*a*, 420*b*. The drive member 440 is for example set in motion by a motor 460 of the station 400, to which motor it is connected for example by means of a transmission device which has not been depicted.

In order to guarantee independent operation of the mobile supports 10 on each side of the machine 1 (on the driver side and on the opposite side) and prevent these from jamming if one of the two foil-introduction chain-like elements 420*a*, 420*b* becomes jammed, these may be connected to the foil-introduction chain-like elements 420*a*, 420*b* by a respective universal joint 18 (FIG. 7).

The drive member 440 may be able to drive the foil-introduction chain-like elements 420*a*, 420*b* in just one (forward) direction or in both directions (forwards and back). The drive bar 430 is for example driven over a full circuit of the path. It returns to the point of introduction I after having passed through the platen press 310. Backwards driving may be used notably if a problem with the driving of the stamping foil occurs.

The first load-measurement device 3*a*' comprises for example a first counter-thrust member 16*a* configured to apply a counter-thrust to the drive member 440 when the foil-introduction chain-like element 420*a*, 420*b* is driven in a first direction. The first counter-thrust member 16*a* is for example an actuator or an elastic member. The actuator is for example a ram, such as a pneumatic ram. The counter-thrust is for example applied to the mobile support 10 fixed to the drive member 440.

The first detector 7*a* is for example configured to detect when the counter-thrust applied by the first counter-thrust member 16*a* crosses a load threshold.

When the drive member 440 is able to drive the foil-introduction chain-like elements 420 in both directions (forwards and back), the driving device 410' may comprise a second load-measurement device 3*b*' for measuring load in the second direction.

The second load-measurement device 3*b*' comprises for example a second counter-thrust member 16*b* configured to apply a counter-thrust to the drive member 440 when the foil-introduction chain-like element 420*a*, 420*b* is driven in the second direction. The second counter-thrust member 16*b* is for example an actuator or an elastic member. The actuator is for example a ram, such as a pneumatic ram. The counter-thrust is for example applied to the mobile support 10 fixed to the drive member 440.

The second detector 7*b* is for example configured to detect when the counter-thrust applied by the second counter-thrust member 16*b* crosses a load threshold.

The counter-thrust members 16*a*, 16*b* apply a counter-thrust on each side of the support 10 with respect to the direction of driving D. The counter-thrusts applied allow for example the support 10 to be kept in position. The counter-thrust in normal operation is for example nil, such that the rods of the actuators are fully extended and simply touch the support 10.

The driving device 410' comprises for example two pairs of load-measurement devices 3*a*', 3*b*', one pair being arranged on a respective foil-introduction chain-like element 420*a*, 420*b* so as to detect an overload on each of the chain-like elements 420*a*, 420*b*.

As in the first embodiment, the detectors 7*a*, 7*b* are for example proximity sensors, namely contactless sensors, such as magnetic sensors. They may be incorporated into a respective actuator. The detectors 7*a*, 7*b* for example send an electrical signal back to the control unit 4 when the measured parameter indicative of the load applied by the drive member 440 crosses a threshold.

The detectors 7*a*, 7*b* may also be produced in the form of any type of movement detector, such as a contact-type sensor.

The driving device 410' may further comprise at least one conventional chain tensioner 17 comprising a mobile intermediate transmission element 453 and an elastic member 5.

One example of the operation of a method for controlling the driving of a stamping foil by means of a driving device 410' will now be described with reference to FIGS. 6 and 7.

The load-measurement devices 3*a*', 3*b*' are initially in a standby position. The motor 460 is stationary, the drive member 440 is immobilized. The operator adjusts the heightwise position of the mobile intermediate transmission elements 452 in order to position the foil-introduction chain-like elements 420*a*, 420*b* at the height of the platen press 310. As a result of this, the mobile intermediate transmission elements 453 move against the action of the elastic members 5. A minimal tension is exerted between the elastic members 5 and the foil-introduction chain-like elements 420*a*, 420*b*.

After the motor 460 has started, the drive member 440 may drive the foil-introduction chain-like elements 420*a*, 420*b* in a first direction (or forward direction, arrow D, FIG. 6, or anticlockwise direction in FIG. 6).

The counter-thrust members 16*a*, 16*b* apply a counter-thrust on each side of the drive member 440 with respect to the direction of driving D. For example, the rods of the actuators are fully extended and simply touch the support 10 on each side.

Should anything happen to block the advance of the foil-introduction chain-like elements 420*a*, 420*b*, the counter-thrust applied by the first counter-thrust member 16*a* will no longer be enough to keep the mobile support 10 in position and it will move (in this instance to the right with respect to the orientation of FIG. 6). The travel of the first counter-thrust member 16*a* decreases for example down to a minimum. These elements for example allow the first detector 7*a* to detect that the counter-thrust applied by the first counter-thrust member 16*a* is crossing a load threshold. The control unit 4 then stops the driving by the drive member 440 for example by cutting the supply of power to the motor 460. Driving may thus be stopped before there is a risk of the drive bar 430 or its attachment breaking.

In normal operation, the drive member 440 may also drive the foil-introduction chain-like elements 420*a*, 420*b* in the opposite second direction (or back direction) (for example by turning clockwise).

Should anything happen to block the advance of the foil-introduction chain-like elements 420*a*, 420*b*, the counter-thrust applied by the second counter-thrust member 16*b* will no longer be enough to keep the mobile support 10 in position and it will move (in this instance to the left) and the travel of the second counter-thrust member 16*b* reduces. These elements for example allow the second detector 7*b* to detect that the counter-thrust applied by the second counter-thrust member 16*b* is crossing a load threshold. The control unit 4 then stops the driving by the drive member 440 for example by cutting the supply of power to the motor 460.

The invention claimed is:

1. A driving device for driving a stamping foil over a path, the driving device comprising:

two foil-introduction chain-like elements; and a drive member coupled to the two foil-introduction chain-like elements for driving the two foil-introduction chain-like elements notably through a platen press, wherein the driving device further comprises at least one first load-measurement device, the at least one first load-measurement device including a first detector configured to measure a parameter indicative of a load applied by the drive member for driving the two foil-introduction chain-like elements in a first direction, the at least one first load-measurement device being connected to a control unit configured to stop the driving by the drive member when the parameter indicative of the load applied by the drive member and measured by the first detector crosses a threshold.

2. The driving device of claim 1, further including a second load-measurement device, the second load-measurement device including a second detector configured to measure a second parameter indicative of the load applied by the drive member for driving the two foil-introduction chain-like elements in a second direction, the second direction being in an opposite direction of the first direction, the second load-measurement device being connected to the control unit configured to stop the driving by the drive member when the second parameter indicative of the load applied by the drive member and measured by the second detector crosses a second threshold.

3. The driving device of claim 2, wherein the second load-measurement device comprises a second counter-thrust member configured to apply a counter-thrust to the drive member when the two foil-introduction chain-like element are driven in the second direction, the second detector being configured to detect when the counter-thrust applied by the second counter-thrust member crosses a load threshold.

4. A method for controlling driving of a stamping foil, wherein the method is implemented by means of the driving device according to claim 3, wherein the first load-measurement device comprises a first counter-thrust member configured to apply a counter-thrust to the drive member when the two foil-introduction chain-like element are driven in the first direction, and wherein the first and second counter-thrust members apply a counter-thrust on each side of the drive member with respect to a direction of driving.

5. The method according to claim 4, wherein the counter-thrust members apply the counter-thrust to the drive member in such a way as to keep the drive member in position.

6. The driving device of claim 1, wherein the first load-measurement device includes:

a first mobile intermediate transmission element, a first elastic member that urges the first intermediate transmission element against a foil-introduction chain-like element situated on one side of the drive member and pulled taut when the foil-introduction chain-like element is driven in the first direction, and a first actuator configured to apply a counter-thrust to the first elastic member when the foil-introduction chain-like element is driven, the first detector being configured to detect when the counter-thrust applied by the first actuator crosses a load threshold.

7. The driving device of claim 6, further comprising a second-load measurement device, wherein the second load-measurement device includes:

a second detector configured to measure a second parameter indicative of the load applied by the drive member for driving the two foil-introduction chain-like elements in a second direction, the second direction being in an opposite direction of the first direction;

a second mobile intermediate transmission element, a second elastic member that urges the second intermediate transmission element against a foil-introduction chain-like element situated on one side of the drive member and pulled taut when the foil-introduction chain-like element is driven in the second direction, and a second actuator configured to apply a counter-thrust to the second elastic member when the foil-introduction chain-like element is driven, the second detector being configured to detect when the counter-thrust applied by the second actuator crosses a load threshold.

8. The driving device of claim 7, wherein the first load-measurement device and/or the second load-measurement device further includes at least one additional intermediate transmission element for guiding the foil-introduction chain-like element through an angle of at least 90°.

9. The driving device of claim 8, wherein the first mobile intermediate transmission element and/or second mobile intermediate transmission element is interposed between the additional intermediate transmission element and the drive member on the path followed by the stamping foil.

10. A method for controlling driving of a stamping foil, wherein the method is implemented by means of the driving device according to claim 7, in which when the foil-introduction chain-like element is driven in the first direction, the first actuator applies a counter-thrust to the first elastic member compression-loaded by a strand of the foil-introduction chain-like element that is pulled taut by the driving of the drive member), the second actuator being inactive, and when the foil-introduction chain-like element is driven in the second direction, the second actuator applies a counter-thrust to the second elastic member compression-loaded by a strand of the foil-introduction chain-like element that is pulled taut by the driving of the drive member, the first actuator being inactive.

11. The method according to claim 10, wherein the activated first actuator and the second actuator apply the counter-thrust to the first elastic member and the second elastic member in such a way as to keep the intermediate transmission elements in position.

12. The driving device of claim 1, wherein the drive member is mounted with the ability to move in a direction of driving of the two foil-introduction chain-like element, the first detector being configured to measure when a movement of the drive member indicative of the load applied by the drive member crosses a threshold.

13. The driving device of claim 12, wherein the first load-measurement device and/or a second load-measurement device further includes a linear guide on which the drive member is slidably mounted.

14. The driving device of claim 12, wherein the drive member comprises a driveshaft coupled to the two foil-introduction chain-like elements by a respective universal joint.

15. The driving device of claim 12, further including two pairs of lower intermediate transmission elements able to move vertically and aligned horizontally to guide each of the two foil-introduction chain-like elements in a horizontal straight line through the platen press.

16. The driving device of claim 1, wherein the first load-measurement device comprises a first counter-thrust member configured to apply a counter-thrust to the drive member when the two foil-introduction chain-like element are driven in the first direction, the first detector being configured to detect when the counter-thrust applied by the first counter-thrust member crosses a load threshold.

17. A stamping-foil feed and recovery station for stamping elements in sheet form, wherein the stamping-foil feed and recovery station includes the driving device according to claim 1.

18. A machine for stamping elements in sheet form, wherein the machine includes a plurality of workstations including the stamping-foil feed and recovery station according to claim 17.

19. A method for controlling driving of a stamping foil, wherein the method is implemented by means of the driving device according to claim 1.

* * * * *